US007594650B2

(12) United States Patent
Chung et al.

(10) Patent No.: US 7,594,650 B2
(45) Date of Patent: Sep. 29, 2009

(54) PAPER FEEDING AND SHEET SEPARATING DIFFERENTIAL DEVICE

(75) Inventors: Ming-Chieh Chung, Kuang-Ln (TW); Hsiu-Hao Cheng, Taoyuan Hsien (TW)

(73) Assignee: Teco Image System Co., Ltd., Taipei (TW)

( * ) Notice: Subject to any disclaimer, the term of this patent is extended or adjusted under 35 U.S.C. 154(b) by 156 days.

(21) Appl. No.: 11/676,234

(22) Filed: Feb. 16, 2007

(65) Prior Publication Data

US 2008/0143040 A1 Jun. 19, 2008

(30) Foreign Application Priority Data

Dec. 19, 2006 (TW) ..... 95147718 A

(51) Int. Cl.
*B65H 3/06* (2006.01)

(52) U.S. Cl. ..... 271/116; 271/121; 271/125

(58) Field of Classification Search ..... 271/109, 271/10.11, 10.01, 121, 125, 114, 116
See application file for complete search history.

(56) References Cited

U.S. PATENT DOCUMENTS 5,435,539 A * 7/1995 Namiki ..... 271/114
5,630,580 A * 5/1997 Tsao et al. ..... 271/10.13
5,678,815 A * 10/1997 Sheng ..... 271/10.13
5,854,695 A * 12/1998 Cho ..... 358/498
6,070,867 A * 6/2000 Tsurumi et al. ..... 271/114
6,547,235 B2 * 4/2003 Higaki ..... 271/10.01
6,719,284 B2 * 4/2004 Hsiao et al. ..... 271/116
7,048,271 B2 * 5/2006 Sheng et al. ..... 271/121
7,399,245 B2 * 7/2008 Spintzyk ..... 474/94
2003/0090052 A1 * 5/2003 Hsiao et al. ..... 271/114
2004/0251595 A1 * 12/2004 Sheng et al. ..... 271/121
2007/0278733 A1 * 12/2007 Lin ..... 271/121

FOREIGN PATENT DOCUMENTS

JP 61257839 A * 11/1986

* cited by examiner

*Primary Examiner*—Kaitlin S Joerger
(74) *Attorney, Agent, or Firm*—Apex Juris, PLLC; Tracy M Heims

(57) ABSTRACT

A paper feeding and sheet separating differential device comprises a rotating shaft, a first roller, a second roller and an insertion pin, in which the first roller is installed on one end of the rotating shaft and comprises a first outer frame and a first raised mass disposed on an inner side of the first outer frame; the second roller is put around the rotating shaft and comprises a second outer frame, an accepting hole disposed inside the second outer frame and used for receiving the rotating shaft, a groove extended axially from the accepting hole to the second outer frame and the second raised mass disposed on an circumference of the accepting hole and used for propping against the first raised mass. Furthermore, the insertion pin is passed through the rotating shaft and then received in the groove.

20 Claims, 8 Drawing Sheets

PAPER FEEDING AND SHEET SEPARATING DIFFERENTIAL DEVICE

CROSS-REFERENCES TO RELATED APPLICATIONS

This non-provisional application claims priority under 35 U.S.C. § 119(a) on Patent Application No(s). 95147718 filed in Taiwan, R.O.C. on 2006 Dec. 19, the entire contents of which are hereby incorporated by reference.

BACKGROUND OF THE INVENTION

1. Field of the Invention

The present invention relates to a differential device, and more particularly to a differential device adapted to paper feeding and sheet separating.

2. Description of the Related Art

Accompany the development of technology, business machines such as facsimile machine, printer, scanner, duplicating machine and etc already become indispensable electronic products in our life. However, not matter what kind of business machine it is, a paper separating device must be installed therein so that paper can be fed one by one.

Please refer to FIGS. 1, 2A and 2B. A conventional paper separating device includes a paper separating roller A1 and a friction wheel A2, in which the paper separating roller A1 is driven by a first rotating shaft A3 to turn and the uses friction force to drive the friction wheel to turn. The friction wheel A2 is constituted by a hollow circular cylinder A21, spring A22, friction sheet A23, fixing element A24 and two C-typed retainer rings A25. The C-typed retainer rings A25 are respectively buckled on two ends of the second rotating shaft Q$, used for providing the spring A22 with an axial force along the second rotating shaft A4 and providing a friction force between the friction sheet A23 and a friction surface A241 of the fixing element. When a paper A5 enters a passageway between the paper separating roller A1 and the friction wheel A2, the friction where Q2 is not turned to allow other papers to be unable to enter, the paper in the passageway can be slid relatively to the friction wheel A2 but not relatively to the paper separating roller A1 so as to attain to the paper separating effect.

However, in such kind of paper separating apparatus, the assembly is very time wasting and laborious to cause the production and assembly costs to be rather high because the C-typed retainer ring is not easy to be manufactured and components therein are too many.

Therefore, for improving the structure of a paper feeding and sheet separating structure and solving the problems such as too many components and complicated structure, the present invention is proposed.

SUMMARY OF THE INVENTION

In view of the deficiencies mentioned above, the present invention proposes a paper feeding and sheet separating differential device, it includes a rotating shaft, an insertion pin, a first roller and a second roller. The insertion pin is passed through and installed on the rotating shaft; the first roller is positioned on one end of the rotating shaft and includes a first outer frame and a first raised mass disposed on an inner side of the first outer frame; the second roller is putting around the rotating shaft and includes a second outer frame, an accepting hole disposed inside the second outer frame and used for accepting the rotating shaft, a groove extended radially from the engaging hole to the second outer frame and used for accepting the insertion pin and a second raised mass disposed on a circumference of the engaging hole and used for propping against the first raised mass. When the second roller is turned with the shaft, it drives the second raised mass to move in the first outer frame to prop against the first raised mass, and the first roller is then allowed to turn to drive the paper to move.

The structure according to the present invention further includes a supporter module installed below the first roller, and a passageway is formed between the supporter module and the first roller to allow a paper to be moved in the passageway. On the basis of this, the structure according to the present invention still further includes a paper feeding roller used for driving a paper to move into the passageway.

Furthermore, the structure according to the present invention further includes a paper delivering roller, and a rotating speed of the paper delivering roller is faster than the rotating shaft. When a paper is moved to the paper delivering roller after the first roller is turned, the paper delivering roller will then drive the paper to displace forward, and the first roller is driven to turn faster by means of the paper displacement.

Whereby, a speed difference is formed between the first roller and the second roller to attain to the paper feeding and the sheet separating objects and to solve the problems such as too many components and the complicated structure in a conventional paper separating device so as to elevate the convenience of the assembly and further to lower down the assembly and the production costs.

The present invention also proposes a paper feeding and sheet separating differential device includes a rotating shaft, an insertion pin, a first roller, a passageway, a second roller, a paper feeding roller and a paper delivering roller. The insertion pin is passed through and installed on the rotating shaft; the first roller is installed on one end of the rotating shaft and includes a first outer frame and a first raised mass disposed on an inner side of the first outer frame; a passageway is positioned below the first roller and a paper in the passageway is moved following the rolling of the first roller; the second roller is put around the rotating shaft and includes a second outer frame, an accepting hole disposed inside the second outer frame and used for accepting the rotating shaft, a groove extended axially from the accepting hole to the second outer frame and used for accepting the insertion pin and a second raised mass disposed on the circumference of the accepting hole and used for propping against the first raised mass to allow the first roller to be turned; the paper feeding roller is used for driving a paper to move into the passageway; the paper delivering roller is used for separating the paper to enter the passageway, and the first roller is driven to change a rotating speed by means of the paper displacement; wherein, a speed difference between the first roller and the second roller allows a spacing yielded between the first raised mass and the second raised mass to cause the first roller to be turned intermittently to process paper feeding and sheet separating.

The structure according to the present invention further includes a supporter module installed below the first roller, and a passageway is formed between the supporter module and the first roller to allow a paper to be moved therein.

Furthermore, a rotating speed of the paper delivering roller is faster than the shaft. When a paper is moved to the paper delivering roller after the first roller is turned, the delivering roller will then drive the paper to move and the first roller is turned faster by means of the paper displacement.

Whereby, a speed difference between the first roller and the second roller to attain to the paper feeding and sheet separating object and to solve the problems such as too many components and the complicated structure in a conventional paper separating device so as to elevate the convenience of the assembly and further to lower down the assembly and the production costs.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
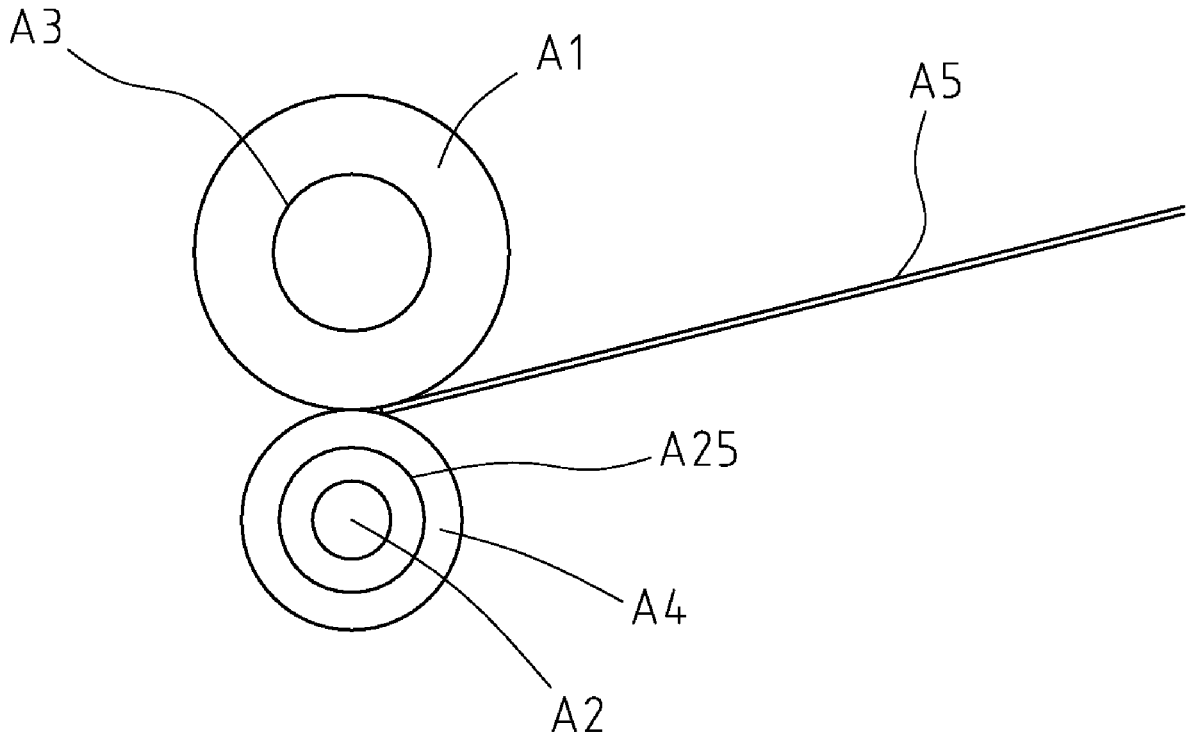
FIG.1 (PRIOR ART)
FIG. 1 is a schematic view of a conventional paper separating device.
Figure 2A:
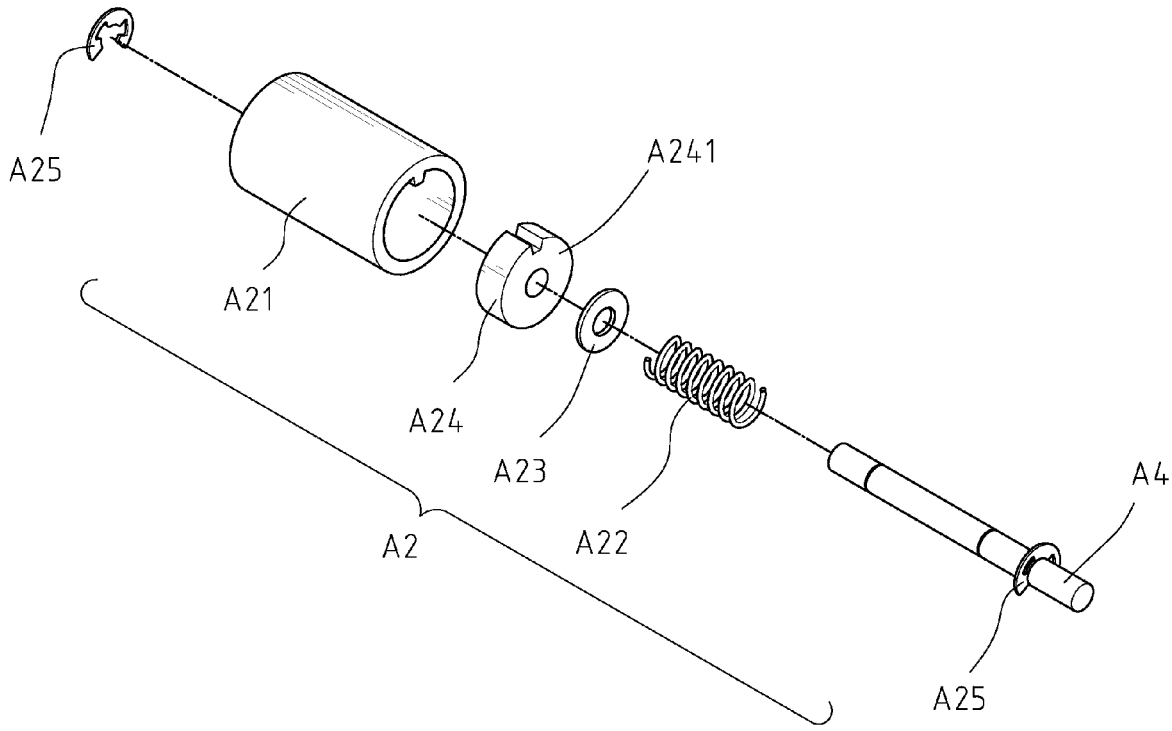
FIG.2A (PRIOR ART)
FIG. 2A is a perspective view of a friction wheel shown in FIG. 1.
Figure 2B:
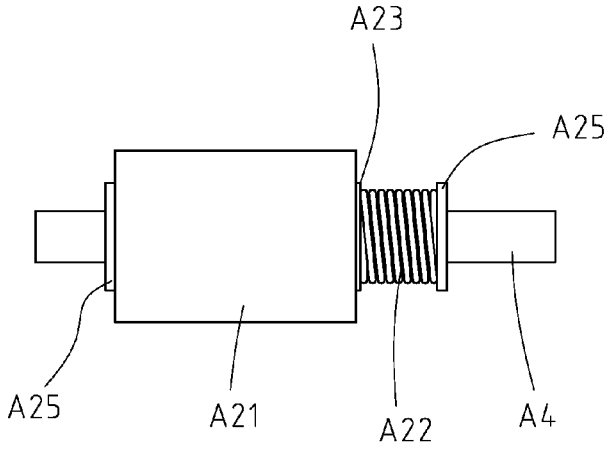
FIG.2B (PRIOR ART)
FIG. 2B is a perspective view of a friction wheel shown in FIG. 1.
Figure 3:
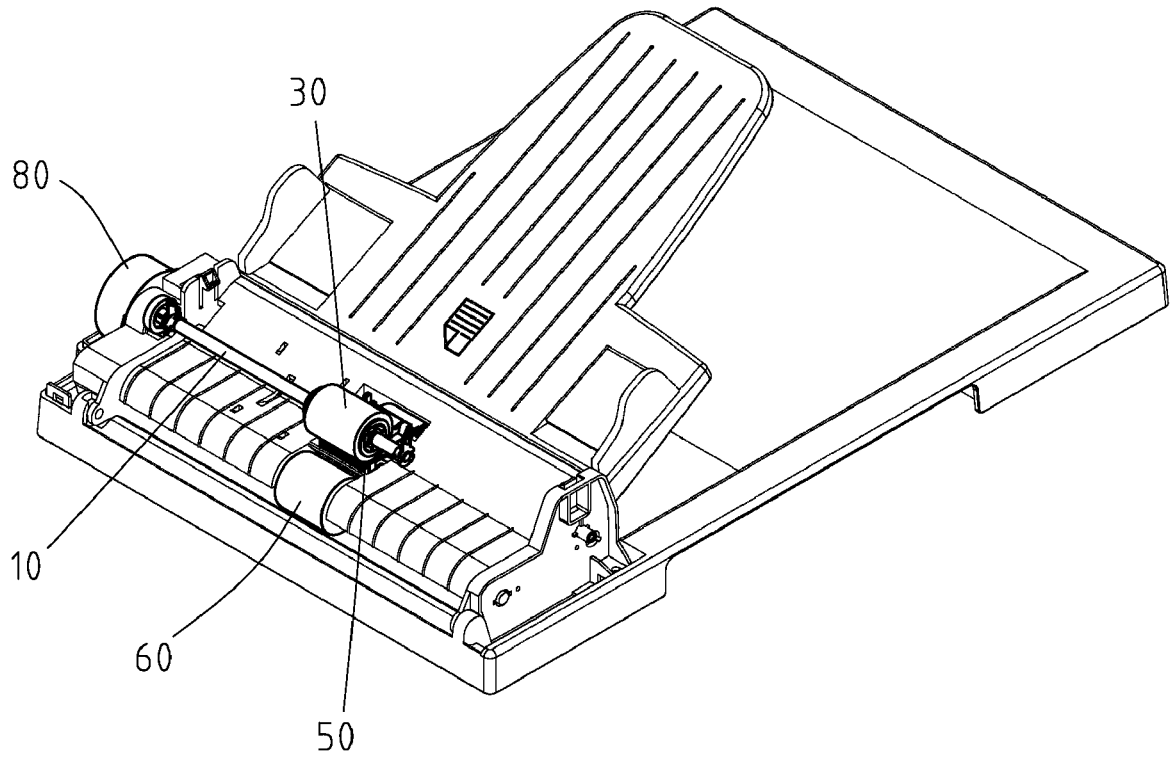
FIG. 3 is a perspective view, showing a paper feeding and sheet separating differential device of a preferred embodiment according to the present invention.
Figure 4:
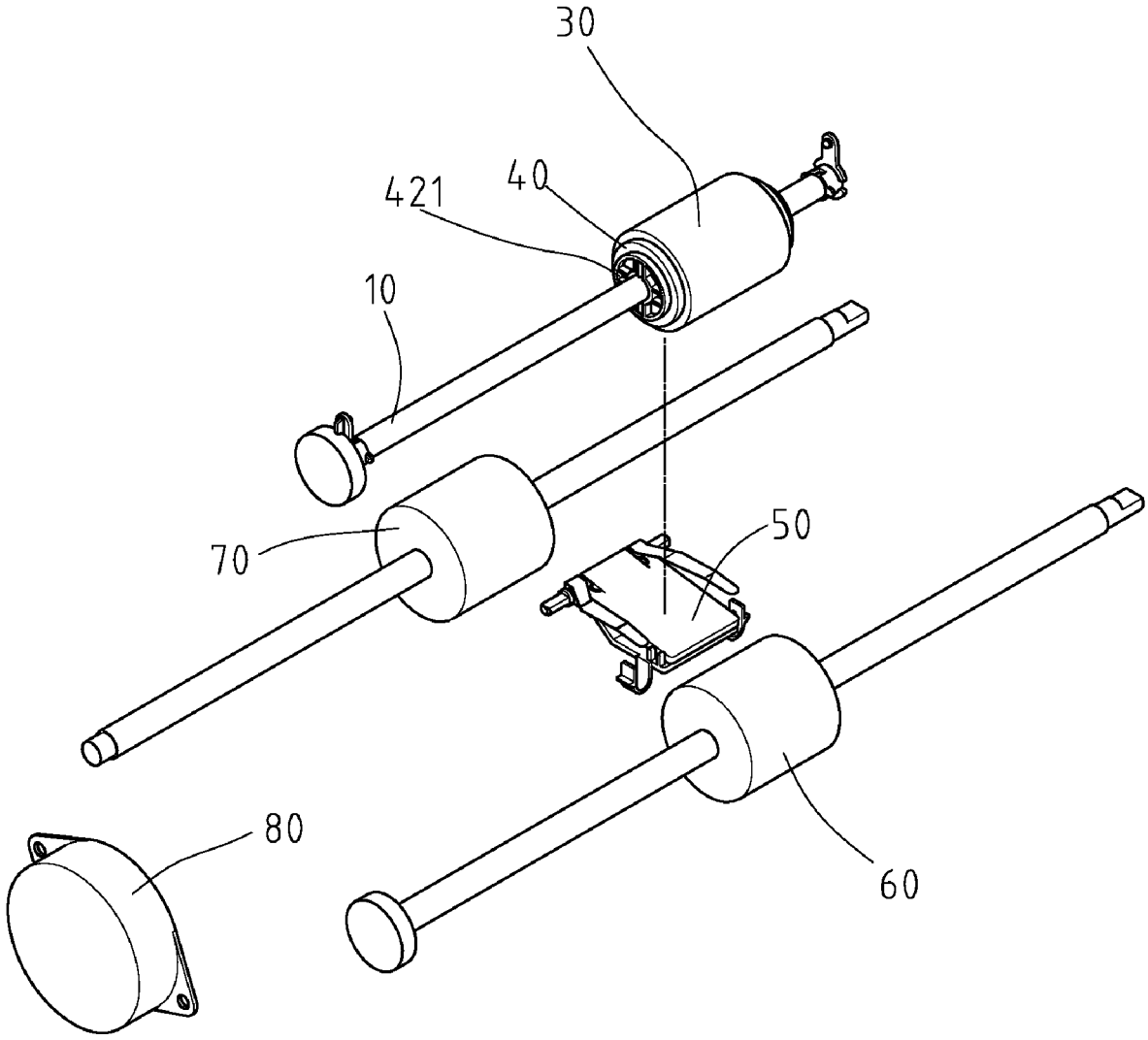
FIG. 4 is an exploded view, showing a paper feeding and sheet separating differential device of a preferred embodiment according to the present invention.
Figure 5:
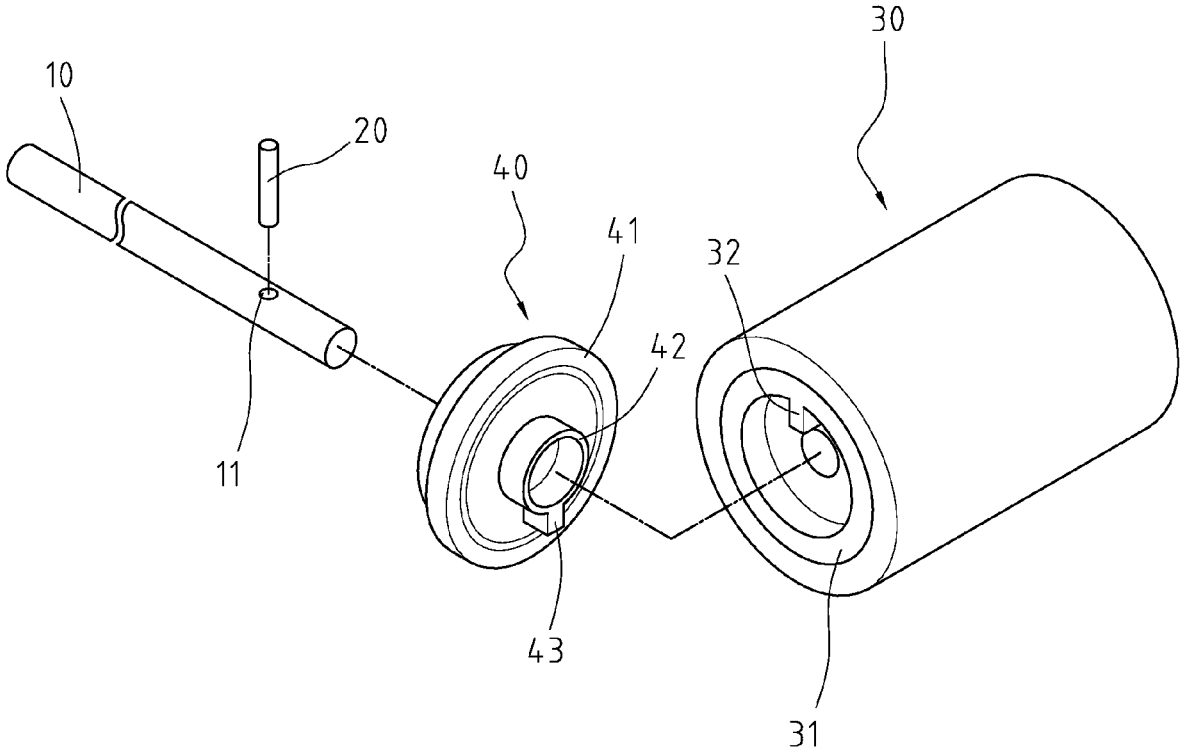
FIG. 5 is a schematic view, showing a first roller and a second roller of a paper feeding and sheet separating differential device of a preferred embodiment according to the present invention.

Please refer to FIGS. 3, 4 and 5. FIG. 3 is a perspective view showing a paper feeding and sheet separating differential device of a preferred embodiment according to the present invention. FIG. 4 is an exploded view showing a paper feeding and sheet separating differential device of a preferred embodiment according to the present invention. FIG. 5 is a schematic view showing a first roller and a second roller of a paper feeding and sheet separating differential device of a preferred embodiment according to the present invention.

A paper feeding and sheet separating differential device includes a rotating shaft 10, an insertion pin 20, a first roller 30 and a second roller 40.

Two ends of the rotating shaft 10 can be accepted on a seat, and a through hole 11 is disposed on the rotating shaft 10.

The insertion pin 20 is passed through the through hole 11 of the rotating shaft 10. Here, the insertion pin 20 and the rotating shaft 10 can be formed separately and then combined each other together, or formed into one body by means of extension formation depending on a practical need.

The first roller 30 is installed on one end of the rotating shaft 10 and includes an outer frame 31. Furthermore, a first raised mass 32 is disposed on an inner side of the first outer frame 31.

The second roller 40 includes a second outer frame 41 and the second outer frame 41 is slightly smaller than the first outer frame 31 to allow a circumference of the second outer frame to be positioned inside the first outer frame 31. The accepting hole 42 is disposed in the second outer frame 41 to allow the second roller 40 to be engaged with the rotating shaft 10, and a groove 421 used for allowing the insertion pin 20 to be placed therein is disposed on the second roller 40 and extended radially from the accepting hole 42 to the second frame 41. Furthermore, a second raised mass 43 used for propping against the first raised mass 32 of the first roller 30 is extended from the circumference of the accepting hole 42 of the second roller 40.

A paper feeding and sheet delivering differential device according to the present invention further includes a supporter module 50 installed below the first roller 30 and a passageway 51 is formed between the supporter module 50 and the first roller 30 to allow a paper 9 to be moved therein. Basing on this, the device according to the present invention further includes a paper delivering roller 70 installed at the end of the passageway 51, and a rotating speed of the paper delivering roller 70 is faster than a rotating speed of the rotating shaft 10 and the second roller 40. Besides, the device according to the present invention also includes a driver module 80 used for driving the rotating shaft 10 and the paper feeding roller 60 to drive.

At least one rib used for partitioning a space inside the first outer frame 31 into a plurality of small spaces can also be disposed in the first roller 30. The distance that the second raised mass 43 of the second roller 40 is moved in the first outer frame 31 can be adjusted by disposing different ribs.

Figure 6A:
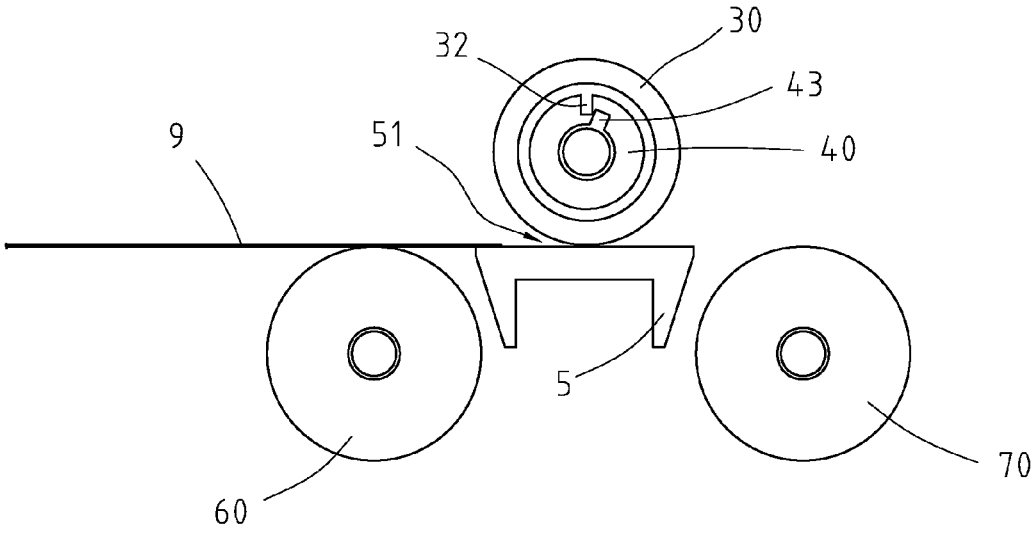
FIGS. 6A to 6E are schematic views, showing a first roller and a second roller in action while being turned according to the present invention.
Figure 6B:
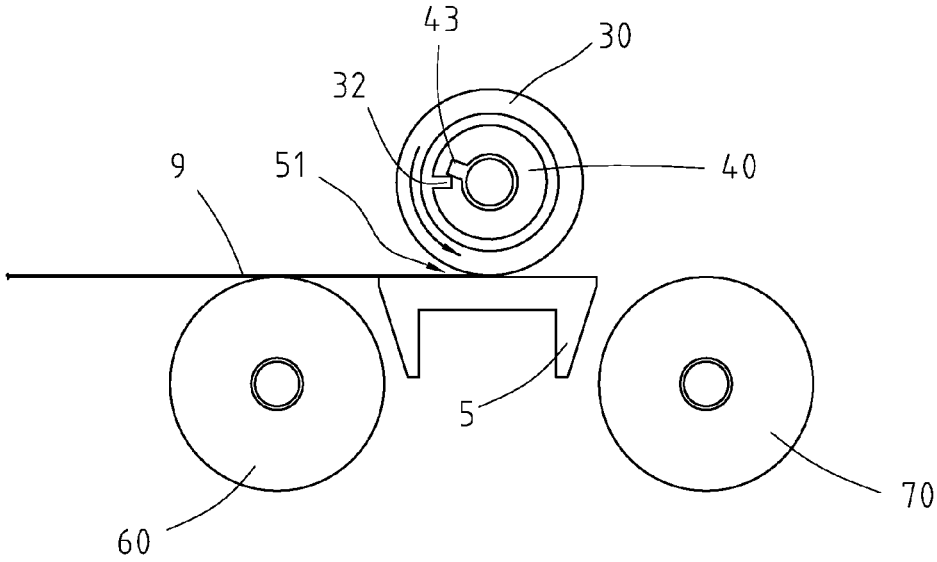
Figure 6C:
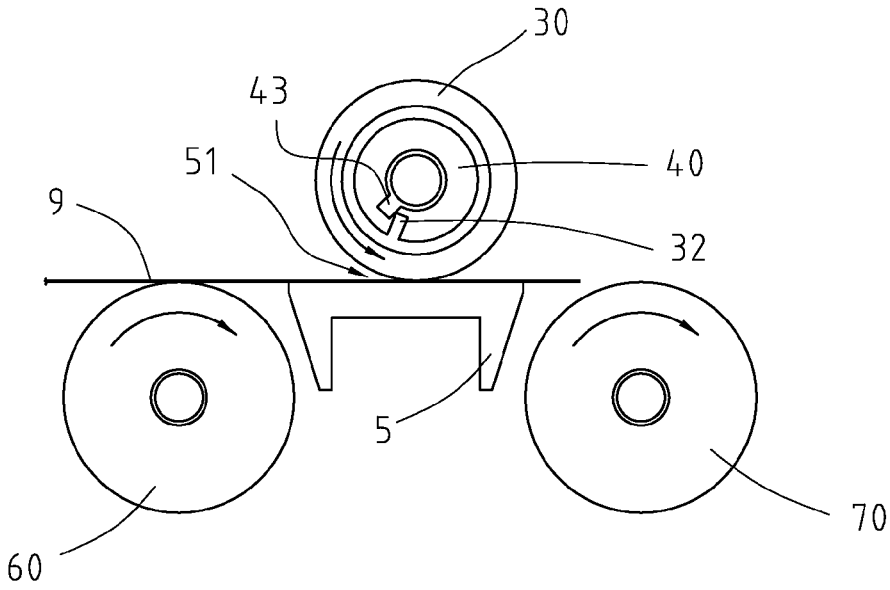
Figure 6D:
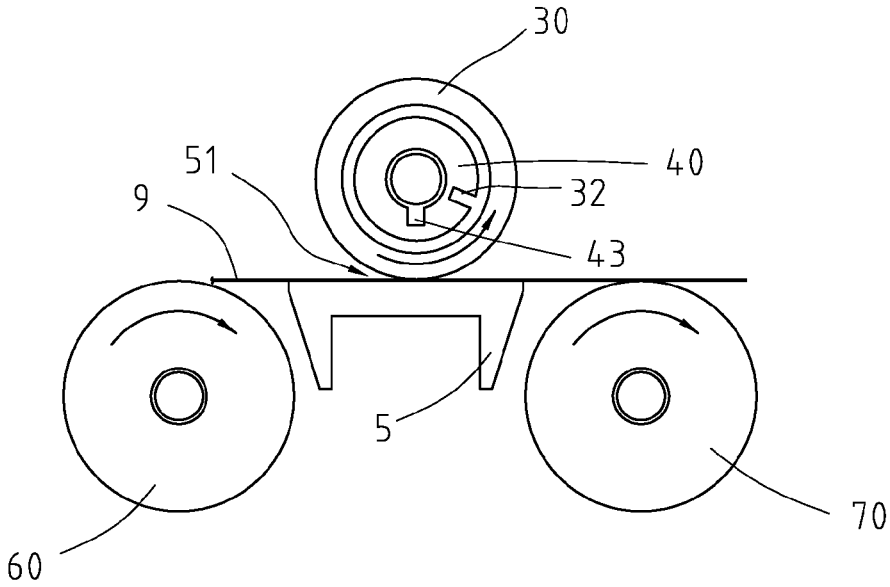
Figure 6E:
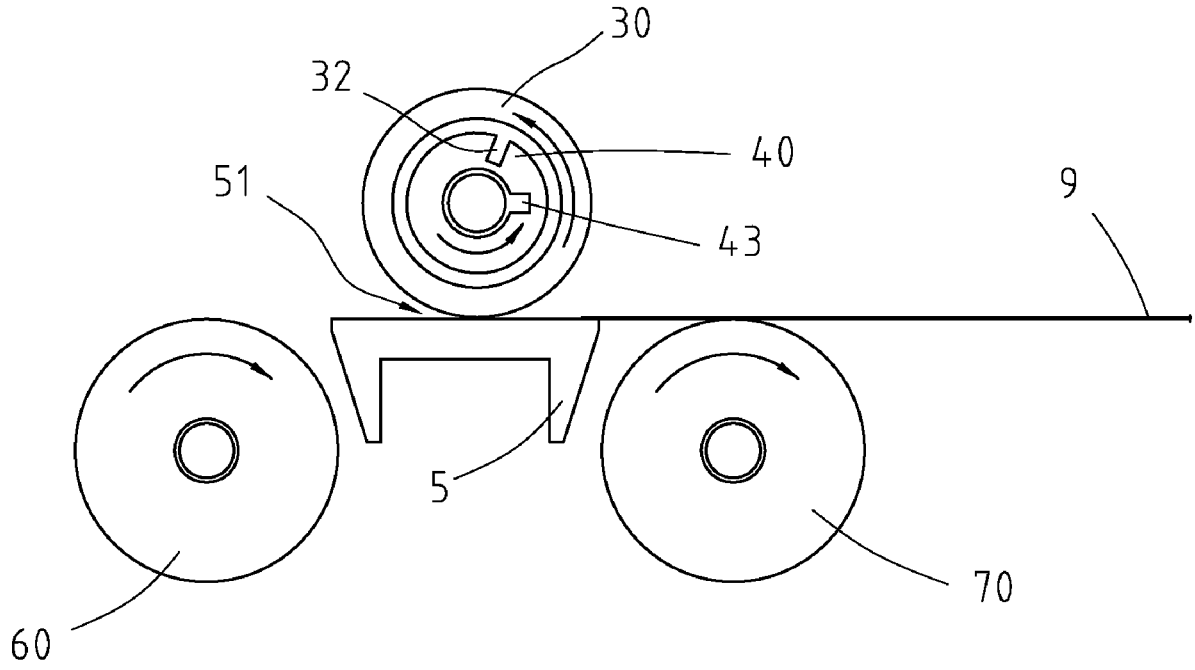

Please refer to FIGS. 6A and 6B. FIGS. 6A and 6B are schematic views showing actions of a first roller and a second roller while being turned of a preferred embodiment according to the present invention.

The driver module 80 first drives the rotating shaft 10 and the paper feeding roller 60 to turn. Thereafter, the rotating shaft 10 drives the second roller 40 to turn through the insertion pin 20 in the groove 421 to allow the second raised mass 43 of the second roller 40 to prop against the first raised mass 32 of the first roller to drive the first roller 30 to turn. In the meantime, the turned paper feeding roller 60 drives a paper 9 to enter the passageway 51 and the paper 9 is driven to move by the first roller 30.

The paper 9 is moved to the paper delivering roller 70 at the end of the passageway 51 after the first roller 30 is turned and then moved by the paper delivering roller 70. Because a rotating speed of the paper delivering roller 70 is faster to allow a moving speed of the paper 9 also become faster and the rotating speed of the first roller 70 is driven to be faster through the movement of the paper 9. In the meantime, a speed difference between the first roller 30 and the second roller 40 causes the first raised mass 32 to eliminate the propping of the second raised mass 43 and a distance between the first raised mass 32 and the second raised mass 43 to be gradually enlarged.

When an end of the paper 9 is separated from the passageway 51, the first roller 30 will loose power and stop turning to allow a following paper 9 not to be moved in the passageway through the second roller 30. In the meantime, the driver module 80 still continues driving the rotating shaft 10 to turn to drive the second roller 40 to turn to allow the distance between the first raised mass 32 and the second raised mass 43 to be gradually reduced. When the second raised mass 43 is propped against the first raised mass 32 again, it can then drive the first roller 30 once more to enable the following paper 9 to be moved.

The speed difference is allowed to form between the first roller 30 and the second roller 40 and the first roller 30 is allowed to be turned intermittently through the structure according to the present invention to attain to the paper feeding and sheet delivering object. Furthermore, the present invention has the merits of few components and simple structure; this allows the assembly of the device to be more convenient and further allows the assembly and the product costs to be decreased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper feeding and sheet separating differential device, adapt to feed a paper sequentially and respectively, comprising:

a rotating shaft;

an insertion pin, passed through and installed on said rotating shaft;

a first roller, installed on one end of said rotating shaft and comprising a first outer frame and a first raised mass disposed on an inner side thereof; and a second roller, put around said rotating shaft and comprising:

a second outer frame;

an accepting hole, disposed inside said second outer frame and used for engaging with said rotating shaft;

at least one groove, extended axially from said accepting hole to said second outer frame and used for receiving said insertion pin; and a second raised mass, disposed on a circumference of said accepting hole and used for propping against said first raised mass;

wherein said second roller is allowed to turn with said rotating shaft, and said second raised mass is driven to move in said first outer frame and props against said first raised mass to cause said first roller to turn to drive said paper to move.

2. The paper feeding and sheet separating differential device according to claim 1, wherein said rotating shaft comprises a through hole used for allowing said insertion pin to be passed through.

3. The paper feeding and sheet separating differential device according to claim 1, wherein said first roller comprises at least one rib used for partitioning a space in said first roller into a plurality of partitioned space.

4. The paper feeding and sheet separating differential device according to claim 1, wherein a circumference of said second outer frame is positioned inside said first outer frame.

5. The paper feeding and sheet separating differential device according to claim 1, wherein said second raised mass is formed by being directly extended from a circumference of said outer frame.

6. The paper feeding and sheet separating differential device according to claim 1, wherein said insertion pin is formed by being directly extended from said rotating shaft.

7. The paper feeding and sheet separating differential device according to claim 1, further comprising a driver module used for driving said rotating shaft to turn.

8. The paper feeding and sheet separating differential device according to claim 1, further comprising a supporter module installed below said first roller.

9. The paper feeding and sheet separating differential device according to claim 8, wherein a passageway is formed between said supporter module and said first roller to allow said paper to be moved therein.

10. The paper feeding and sheet separating differential device according to claim 9, further comprising a paper feeding roller used for driving said paper to enter said passageway.

11. The paper feeding and sheet separating differential device according to claim 1, further comprising a paper delivering roller, said paper being moved to said paper delivering roller after said first roller is turned.

12. A paper feeding and sheet separating differential device, adapt to feed a paper sequentially and respectively, comprising:

a rotating shaft;

an insertion pin, passed through and installed on said rotating shaft;

a first roller, installed on one end of said rotating shaft and comprising a first outer frame and a first raised mass disposed on an inner side thereof;

a passageway, positioned below said first roller, said paper in said passageway being moved following a rolling of said fist roller;

a second roller, put around said rotating shaft and comprising:

a second outer frame;

an accepting hole, disposed inside said second outer frame and used for engaging with said rotating shaft;

at least one groove, extended axially from said accepting hole to said second outer frame and used for receiving said insertion pin; and a second raised mass, disposed on a circumference of said accepting hole and used for propping against said first raised mass;

a paper feeding roller, used for driving said paper to enter said passageway; and a paper delivering roller, used for separating said paper to enter said passageway and said first roller being driven to change a rotating speed thereof by means of the displacement of said paper;

wherein a speed difference between said first roller and the second roller to allow a distance to be yielded between said first raised mass and said second raised mass to cause said first roller to be turned intermittently to process paper feeding and sheet separating.

13. The paper feeding and sheet separating differential device according to claim 12, wherein said rotating shaft comprises a through hole used for allowing said insertion pin to be passed through.

14. The paper feeding and sheet separating differential device according to claim 12, wherein said first roller comprises at least one rib used for partitioning a space in said first roller into a plurality of partitioned space.

15. The paper feeding and sheet separating differential device according to claim 12, wherein a circumference of said second outer frame is positioned inside said first outer frame.

16. The paper feeding and sheet separating differential device according to claim 12, wherein said second raised mass is formed by being directly extended from a circumference of said outer frame.

17. The paper feeding and sheet separating differential device according to claim 12, wherein said insertion pin is formed by being directly extended from said rotating shaft.

18. The paper feeding and sheet separating differential device according to claim 12, further comprising a supporter module installed below said first roller.

19. The paper feeding and sheet separating differential device according to claim 12, wherein a passageway is formed between said supporter module and said first roller to allow said paper to be moved therein.

20. The paper feeding and sheet separating differential device according to claim 12, wherein a rotating speed of said paper delivering roller is faster than a rotating speed of said rotating shaft and said second roller.

* * * * *